US008740312B1

(12) United States Patent
Lowery

(10) Patent No.: US 8,740,312 B1
(45) Date of Patent: Jun. 3, 2014

(54) MINING SLED WITH MOVABLE BED

(76) Inventor: Sterling Wayne Lowery, Glen Allen, VA (US)

( * ) Notice: Subject to any disclaimer, the term of this patent is extended or adjusted under 35 U.S.C. 154(b) by 61 days.

(21) Appl. No.: 13/547,499

(22) Filed: Jul. 12, 2012

Related U.S. Application Data

(60) Provisional application No. 61/572,348, filed on Jul. 14, 2011.

(51) Int. Cl.
*E21F 13/00* (2006.01)
*E21D 9/12* (2006.01)
*E21F 13/06* (2006.01)

(52) U.S. Cl.
CPC ..... *E21F 13/00* (2013.01); *E21F 13/063* (2013.01); *E21D 9/12* (2013.01)
USPC ..... 299/64; 299/95

(58) Field of Classification Search
CPC ..... E21F 13/00; E21F 13/025; E21F 13/063; B61D 11/00; B61D 11/02; E21D 9/126; E21D 9/12
USPC ..... 299/64, 67, 95
See application file for complete search history.

(56) References Cited

U.S. PATENT DOCUMENTS

| | | | | |
|---|---|---|---|---|
| 3,826,387 | A * | 7/1974 | Galis | 414/551 |
| 4,074,920 | A | 2/1978 | Joyce | |
| 4,537,554 | A * | 8/1985 | Collins, Jr. | 414/328 |
| 5,582,465 | A * | 12/1996 | Mraz | 299/18 |
| 5,692,807 | A | 12/1997 | Zimmerman | |
| 5,810,447 | A | 9/1998 | Christopher et al. | |
| 6,042,191 | A | 3/2000 | Antoline et al. | |
| 7,594,702 | B2 * | 9/2009 | Lowery | 299/64 |
| 2010/0308639 | A1 * | 12/2010 | Cushman | 299/18 |

* cited by examiner

*Primary Examiner* — David Bagnell
*Assistant Examiner* — Michael Goodwin

(57) ABSTRACT

A mining sled with a movable bed. The movable bed nests within the sled and is slidable with respect to the sled. Stops are located on the sled to limit the distance the movable bed can travel with respect to the sled. The movable bed includes brackets at a first end for attachment to the pull-out rope of a pull-out winch. The second end of the movable bed includes a mount for attachment of a pulley. The pulley on the movable bed facilitates attachment to a pull-in rope that is connected to a pull-in winch for transporting the sled toward the continuous miner.

19 Claims, 8 Drawing Sheets

MINING SLED WITH MOVABLE BED

This application claims the benefit and priority date of Provisional Application 61/572,348 filed Jul. 14, 2011 in the name of Sterling Wayne Lowery.

FIELD OF THE INVENTION

This invention relates to devices for moving ore out of a mine and more specifically to a sled with a movable bed which greatly improves the productivity of winch-operated mining systems.

BACKGROUND OF THE INVENTION

Highwall mining is generally a method of mining whereby a remotely controlled continuous miner is positioned in a shaft to mine or cut ore from ore-bearing strata at a face area. The harvested ore is then transported to a bench area outside the shaft. Since the shaft is only wide enough to accommodate the miner and ore removal machinery, any machinery sent into the shaft cannot be turned around.

One method commonly used to transport ore from the continuous miner to an area outside the mine shaft is a winch-operated system. Winch-operated highwall mining systems commonly use a sled to transport the ore from the continuous miner to the bench area. A winch-operated highwall mining system is depicted in commonly owned U.S. Pat. No. 7,594,702, the entire contents of which are incorporated herein by reference thereto.

Operation of the winch-operated highwall mining system includes first pulling the empty sled to the continuous miner, holding the sled in position while the sled is filled by the continuous miner, and then pulling the sled away from the continuous miner to the bench area where it is unloaded.

The productivity of the aforementioned winch-operated highwall mining system is severely restricted by the usable load area of the sled. Increasing the sled length does not result in an increase in the productivity as the loadable area of the sled is limited to the load-distribution reach of the continuous miner. Thus, if a highwall mining sled is increased in length, it will not lead to an increase in productivity as the portion of the sled beyond the load-distribution reach will be unreachable by the continuous miner. As a consequence of the winch cabling to control the sled, a sled cannot be turned around in a winch-operated highwall mining system. Thus, it is not possible to turn a sled around within the highwall mine shaft in order to load the opposite end of the sled.

What is needed therefore is a device for improving the productivity of a winch-operated highwall mining system while avoiding the limitation imposed by the load-distribution reach of the continuous miner.

SUMMARY OF THE INVENTION

The present invention is directed to a mining sled with a movable bed. The movable bed nests within the sled and is slidable with respect to the sled. Stops are located on the sled to limit the distance the movable bed can travel with respect to the sled. The movable bed includes brackets at a first end for attachment to the pull-out rope of a pull-out winch. The second end of the movable bed includes a mount for attachment of a pulley. The pulley on the movable bed facilitates attachment to a pull-in rope that is connected to a pull-in winch for transporting the sled toward the continuous miner.

OBJECTS AND ADVANTAGES

The sled of the present invention substantially doubles the productivity of a winch-operated highwall mining system.

The sled overcomes the limitations imposed by the load-distribution reach of the continuous miner and the single orientation limitation of the sled imposed by the highwall mining operation. By providing a movable bed that can be moved from one end of the sled to the opposing end by action of the winch, the usable loading area of the sled is greatly expanded, thereby substantially doubling productivity of the winch-operated mining system. The sled with movable bed enables a continuous miner boom to load more tons on the sled per each cycle in and out of the mine.

INDEX TO REFERENCE NUMERALS IN THE DRAWINGS

Figure 1:
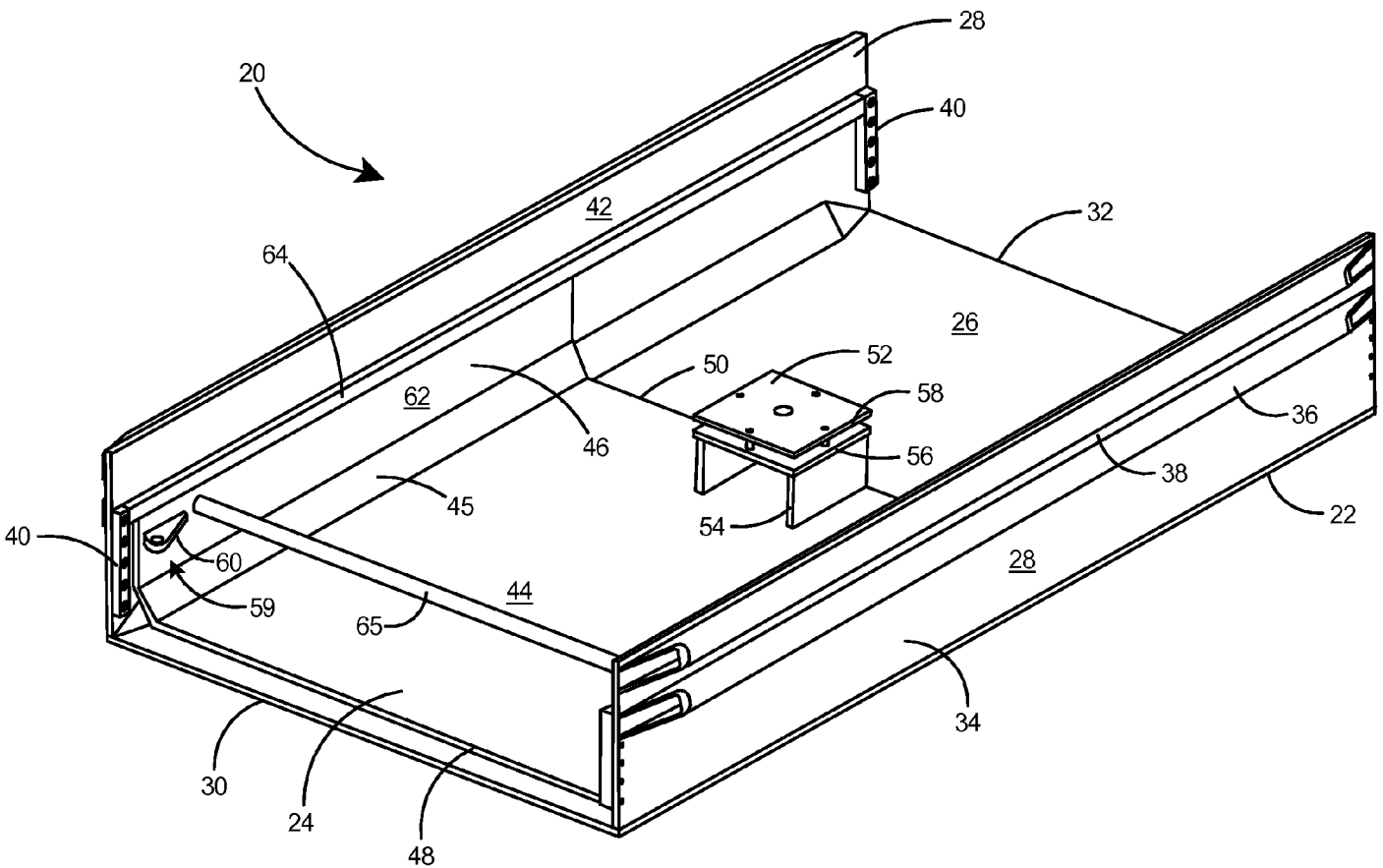
FIG. 1 is a perspective view of the preferred embodiment of a mining sled with movable bed according to the present invention.
Figure 2:
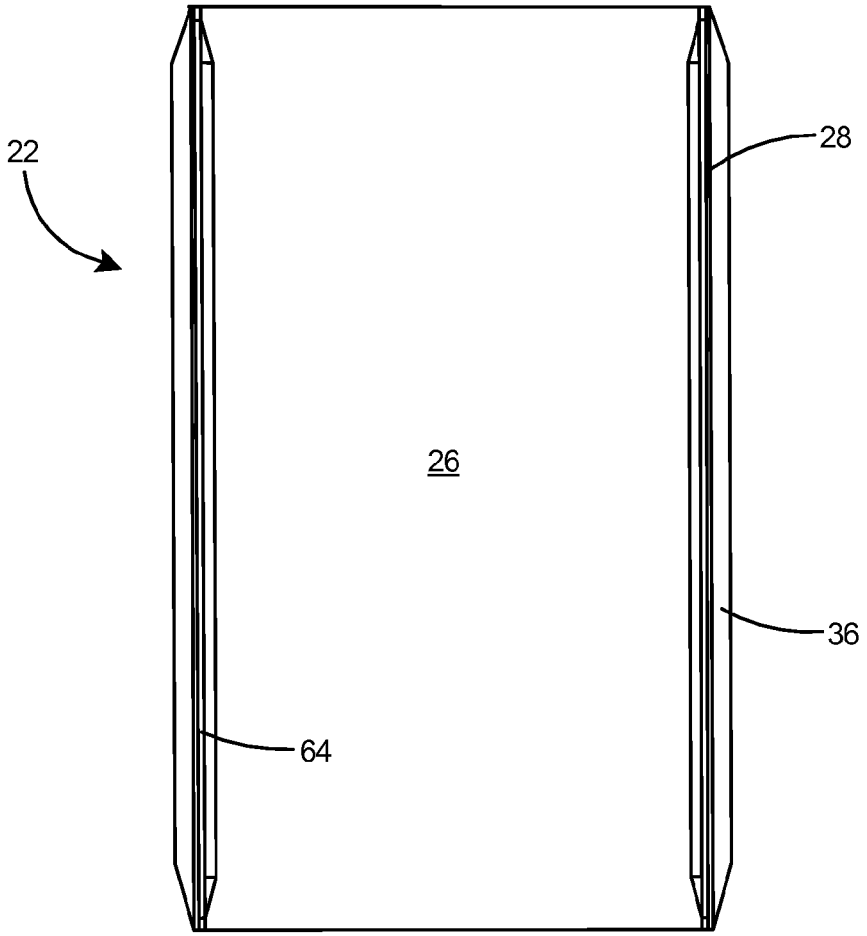
FIG. 2 is a top view of the sled body portion of the mining sled of FIG. 1.
Figure 3:
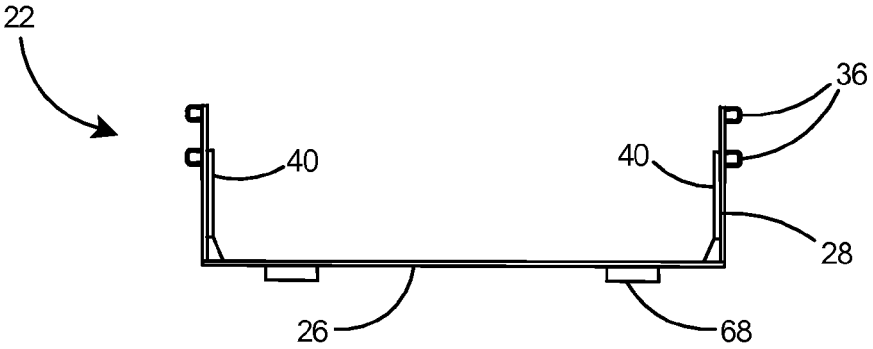
FIG. 3 is an end view of the sled body of FIG. 2.
Figure 4:
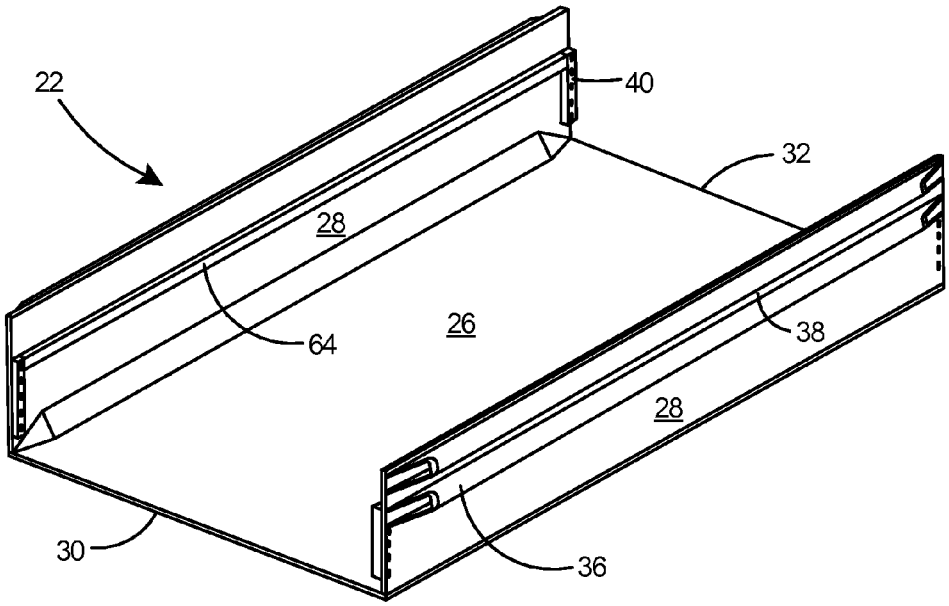
FIG. 4 is a top perspective view of the sled body.

| | |
|---|---|
| 20 | mining sled with movable bed |
| 22 | sled body |
| 24 | movable bed |
| 26 | sled base |
| 28 | sled sidewall |
| 30 | pull-out end of sled |
| 32 | pull-in end of sled |
| 34 | outer surface of sled sidewall |
| 36 | rub rail |
| 38 | rope channel |
| 40 | bed stop |
| 42 | inner surface of sled sidewalls |
| 44 | bed base |
| 45 | sloped corner |
| 46 | bed sidewall |
| 48 | pull-out end of movable bed |
| 50 | pull-in end of movable bed |
| 52 | pulley support |
| 54 | leg |
| 56 | base plate |
| 58 | top plate |
| 59 | cable attachment mechanism |
| 60 | bracket |
| 62 | inner surface of bed sidewall |
| 64 | sleeve |
| 65 | spreader bar |
| 66 | bottom surface of sled body |
| 68 | skid plate |
| 70 | bolt |
| 72 | base of sleeve |
| 74 | lip |

-continued

| INDEX TO REFERENCE NUMERALS IN THE DRAWINGS | |
|---|---|
| 76 | channel |
| 78 | aperture in bracket |
| 80 | plow edge |
| 82 | strut |
| 84 | shaft |
| 86 | pull-in pulley |
| 88 | winch-operated highwall mining system |
| 89 | conventional prior art mining sled |
| 90 | pull-in winch |
| 91 | pull-in rope |
| 92 | continuous miner |
| 93 | boom |
| 94 | chain conveyor |
| 95 | pull-out winch |
| 96 | pull-out rope |
| 97 | sling |
| 98 | pulley on continuous miner |

DETAILED DESCRIPTION OF THE INVENTION

With reference to FIG. 1 there is shown the preferred embodiment of a mining sled 20 according to the present invention. The mining sled 20 includes a sled body 22 and a movable bed 24. The sled body 22 includes a sled base 26, two sled sidewalls 28 extending from the sled base 26, a first or pull-out end 30, and a second or pull-in end 32. The sled sidewalls 28 include an inner surface 33, an outer surface 34 and two rub rails 36 extend longitudinally along the outer surface 28. The rub rails 36 include a separation there between defining a rope channel 38 on the exterior of the sidewalls 28. A bed stop 40 is provided on the inner surface 42 of the sled sidewalls 28 at both the pull-out end 30 and the pull-in end 32.

The movable bed 24 includes a bed base 44, two corners 45, two bed sidewalls 46 extending from the corners 45, a first or pull-out end 48, and a second or pull-in end 50. A pulley support 52 extends from the bed base 44 at the pull-in end 50 of the movable bed 24. The pulley support 52 includes two legs 54, a base plate 56, and a top plate 58 with the legs 54 extending from the bed base 44 to the base plate 56. A cable attachment mechanism 59 at the pull-out end 48 of the movable bed 24 includes a bracket 60 extending from the inner surface 62 of each of the bed sidewalls 46. A sleeve 64 extends longitudinally along the length of the inner surface 42 of the sled sidewalls 28 and holds the movable bed 24 within the confines of the sled body 22. A spreader bar 65 extends between the two bed sidewalls 46 and is typically welded thereto in order to stabilize the bed sidewalls 46 and prevent them from buckling or bending inwards. Spreader bar 65 extends from said bed sidewalls 46 near said brackets 60 but in a position that will not interfere with later attachment of a rope or cable to the brackets 60. Movable bed 24 is slideable within the sled body 22.

Figure 5:
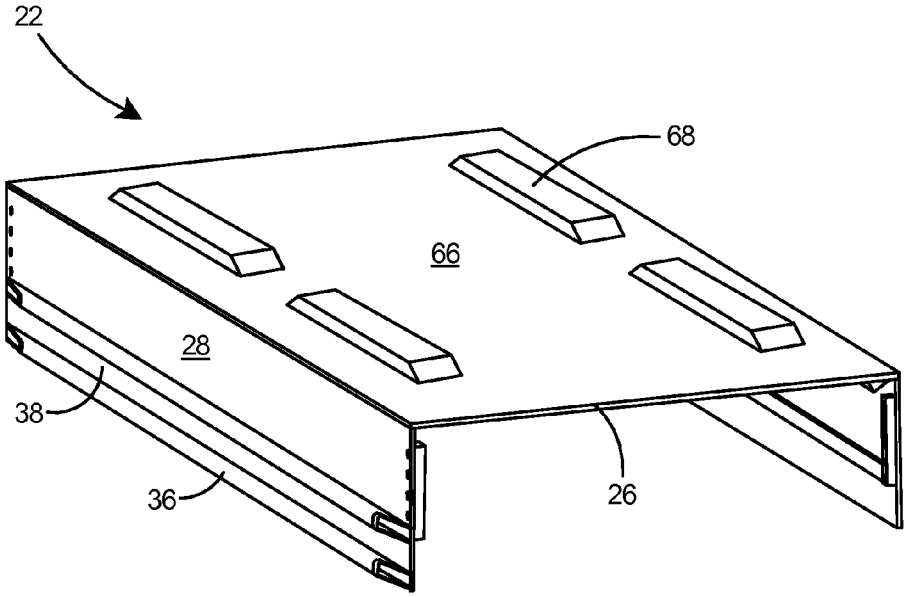
FIG. 5 is a bottom perspective view of the sled body.
Figure 6:
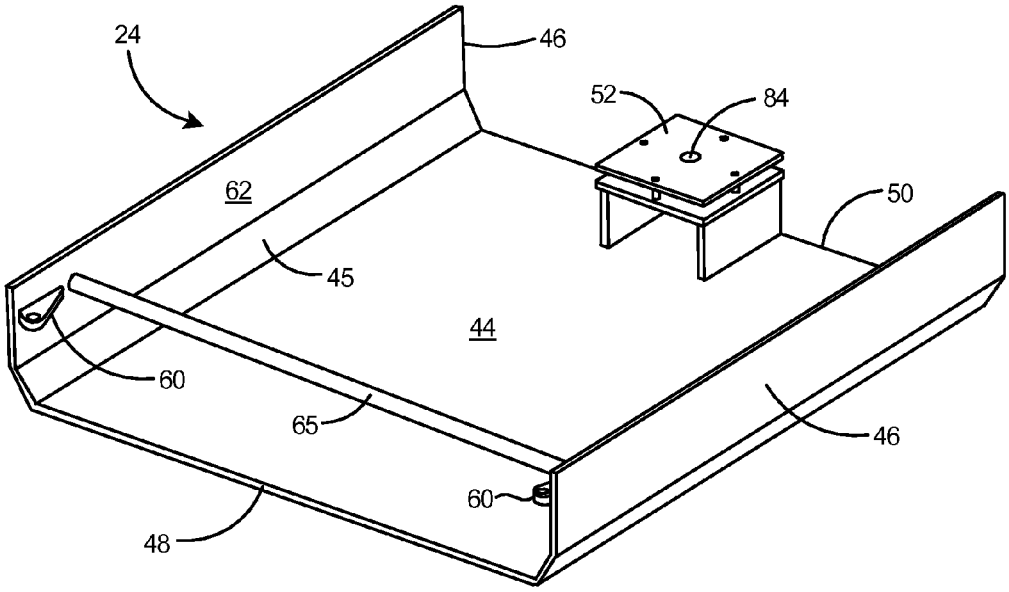
FIG. 6 is a perspective view of the movable bed portion of the mining sled of FIG. 1.

Referring to FIG. 5, the sled base 26 of sled body 22 includes a bottom surface 66 and one or more skid plates 68 integral with the bottom surface 66. As the Mine Safety and Health Administration (MSHA) regulations stipulate that personnel cannot enter highwall mine shafts, highwall mines typically have unimproved floors and thus there typically are no rails, conveyors, or similar apparatus for transporting ore out of the mine. The skid plates 68 therefore function to maintain contact with the unimproved floor of the mine and provide a thick surface that is better able to absorb the wear and tear of continually traversing through the mine shaft and thereby minimize the wear and tear on the sled base 26.

Figure 7:
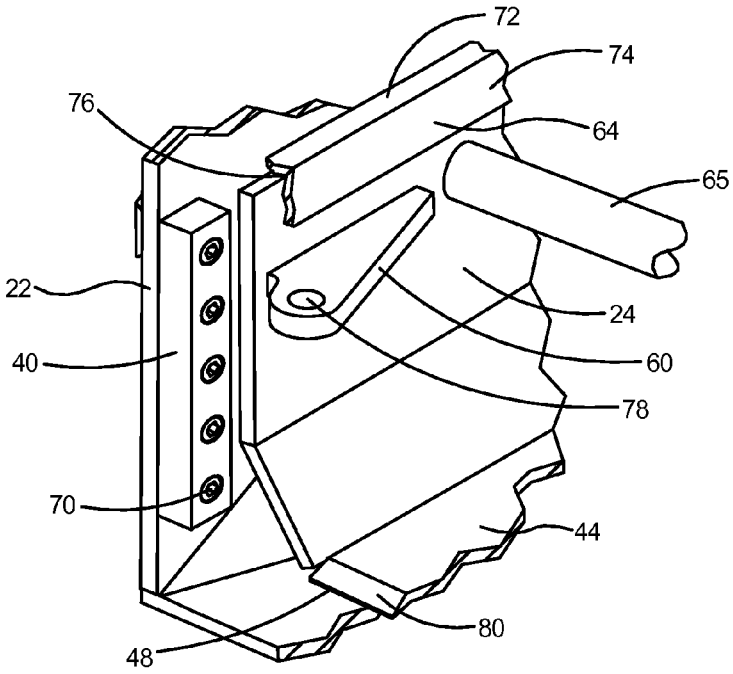
FIG. 7 is a detail view of a portion of the pull-out end of the mining sled depicting a stop on the sled body and a bracket on the movable bed.
Figure 8:
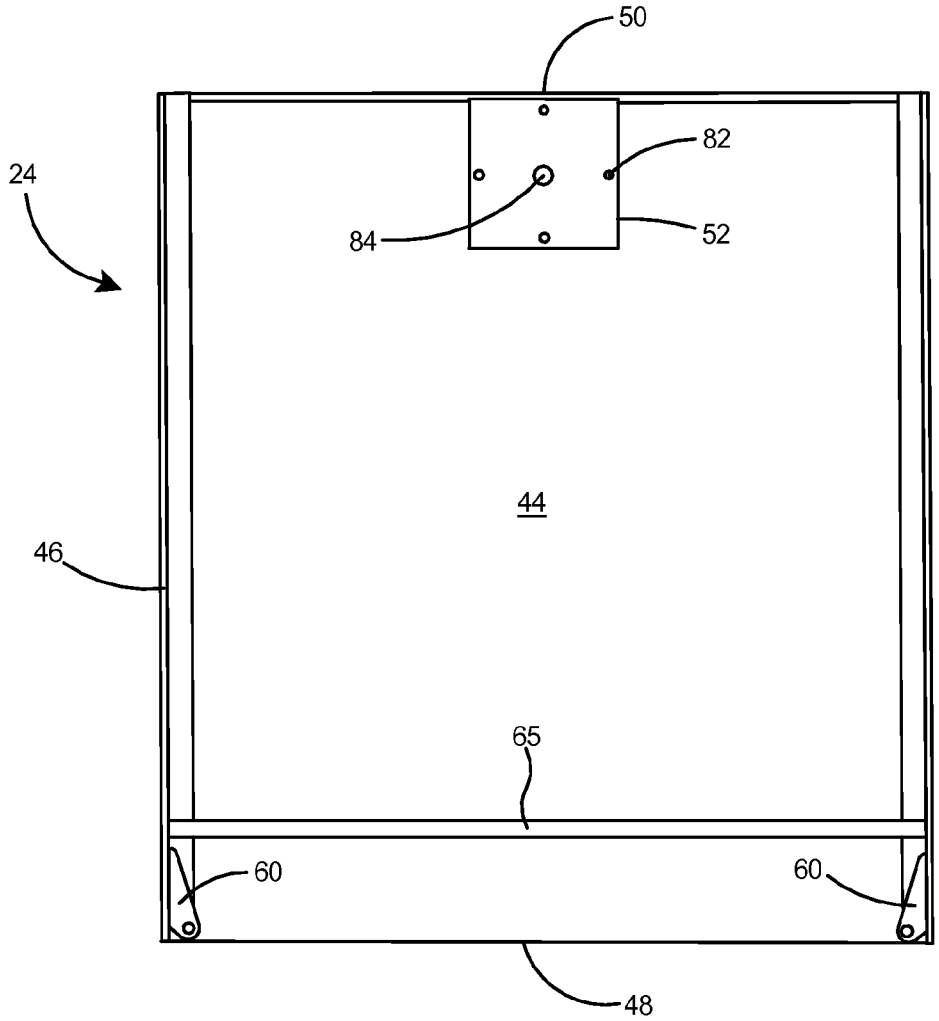
FIG. 8 is a top view of the movable bed.

With reference to FIG. 7, there is shown a detailed view of the pull-out end 48 of the movable bed 24. The bed stop 40 limits the travel of the movable bed 24 with respect to the sled body 22. The connection of the bed stop 40 to the sled sidewall 28 is depicted with bolts 70, but it is within the scope of the invention that bed stops 40 are welded onto the sled sidewalls 28. Most preferably the bed stops 40 are vertical bars bolted or welded to the sled sidewalls 28. The sleeves 64 include a base portion 72 secured to the sled sidewalls 28 and a lip 74 extending downward from the base portion 72. The lip 74 and base portion 72 form a channel 76 for containing the bed sidewalls 46 and guiding the travel of the movable bed 24 within the sled body 22. Bracket 60 includes an aperture 78 therein. The ends 48 and 50 of the bed base 44 include a plow edge 80 thereon to facilitate travel of the movable bed 24 within the sled body 22 and to insure that any ore spilled on the sled base 26 is scraped onto the bed base 44 with movement of the movable bed 24 within the sled body 22. The plow edge 80 rides under and lifts any ore that is on the sled base 26 thereby forcing under the ore and moving it onto the bed base 44 as the movable bed 24 travels within the sled body 22.

Figure 9:
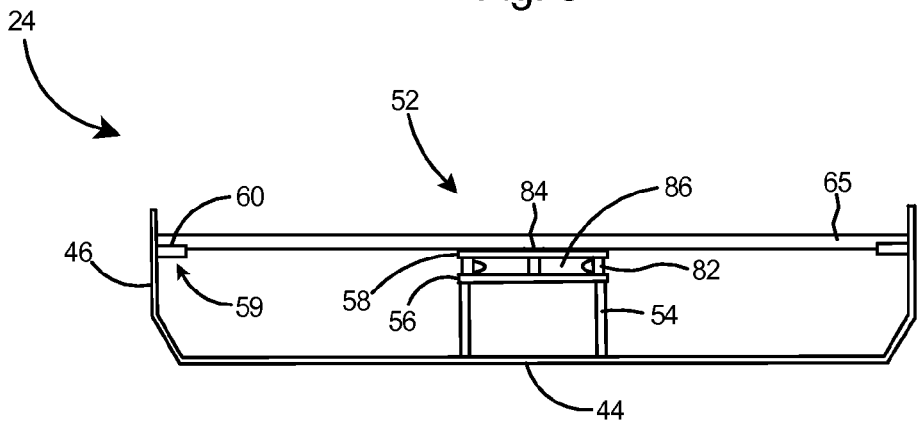
FIG. 9 is an end view of the movable bed.
Figure 10:
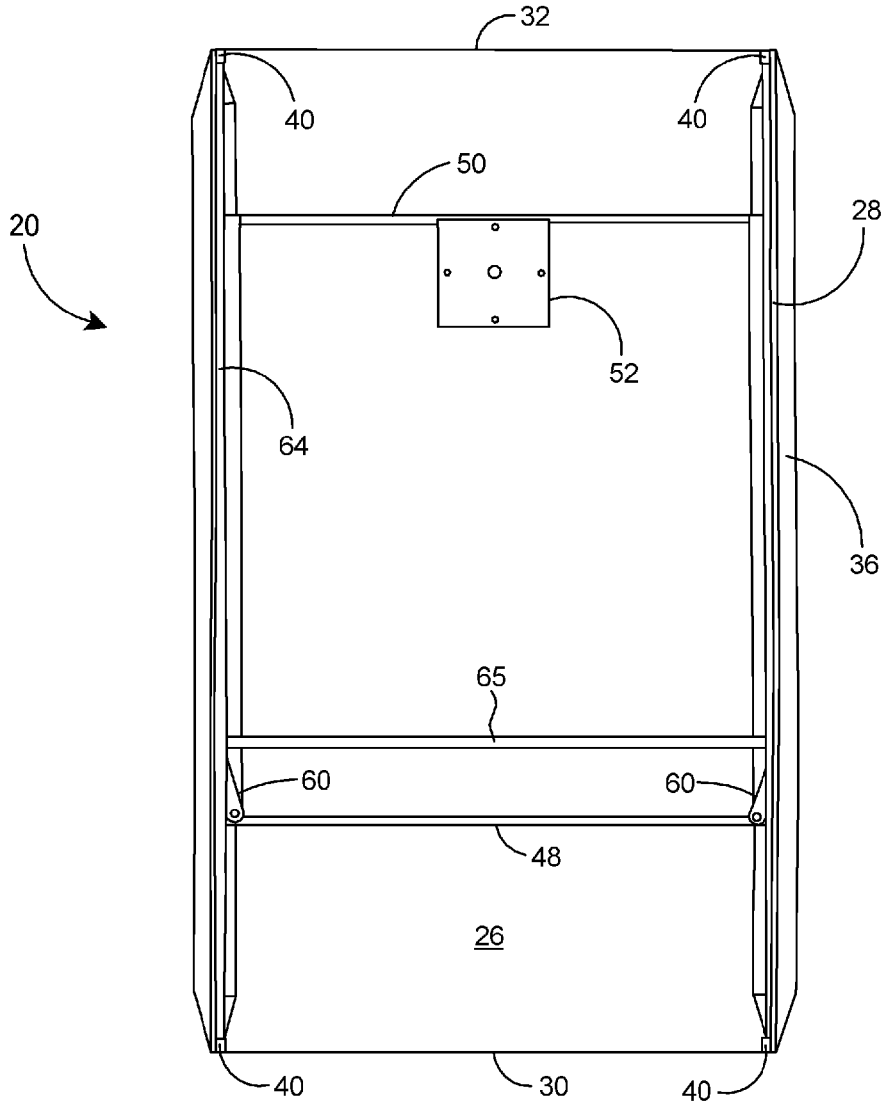
FIG. 10 is a top view of the mining sled of the present invention.
Figure 11:
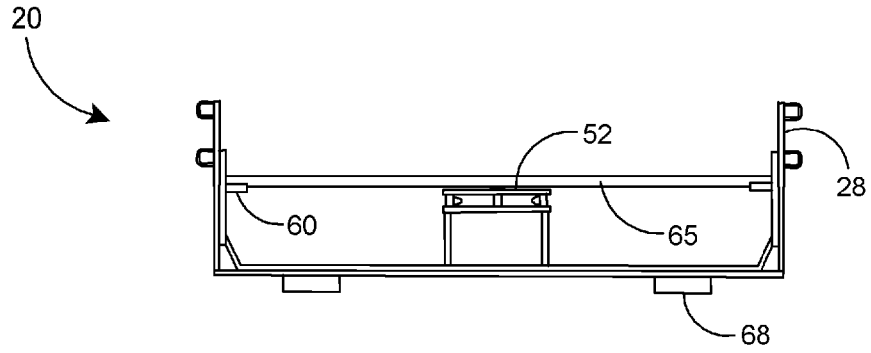
FIG. 11 is an end view of the mining sled of the present invention.

With reference to FIG. 9, the pulley support 52 further includes a plurality of struts 82 extending between the base plate 56 and the top plate 58. A shaft 84 extends between the base plate 56 and the top plate 58 and includes a pull-in pulley 86 on the shaft 84. Pull-in pulley 86 provides a connection point for connection of a pull-in rope (not shown) of a winch-operated highwall mining system.

Figure 12:
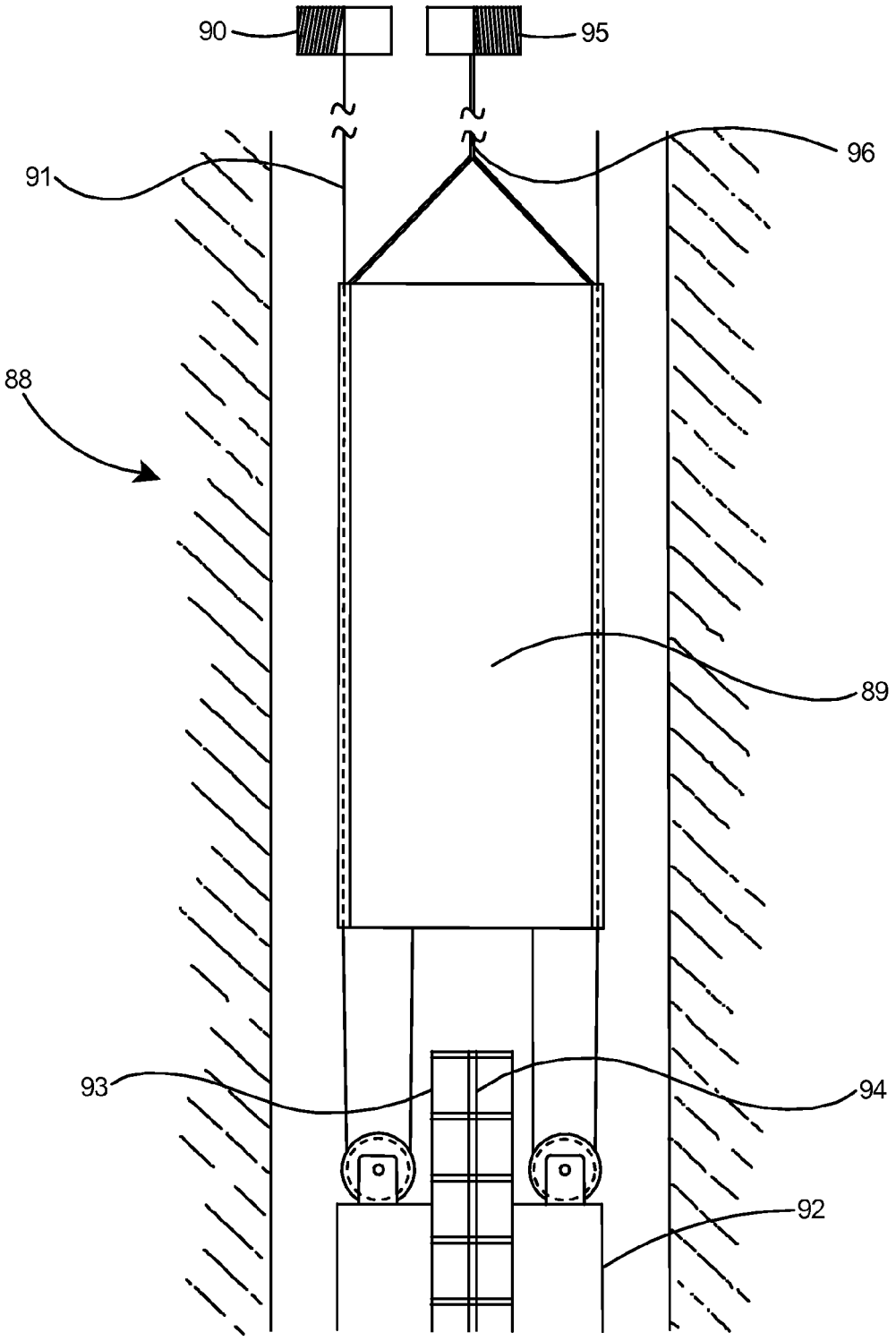
Fig. 12 (PRIOR ART)
FIG. 12 is an overhead view of a winch-operated mining system utilizing a conventional mining sled of the prior art.

With reference to FIG. 12, there is depicted a conventional winch-operated highwall mining system 88 using a conventional prior art mining sled 89 to transport mined coal. In the winch-operated highwall mining system, a pull-in winch 90 is used to operate a pull-in rope 91 and pull the sled 89 into a mine to a stationary loading position behind a continuous miner 92. In the loading position, a boom 93 on the continuous miner 92 guides a chain conveyor 94 which dumps the mined coal onto the sled 89. The boom 93 of a conventional continuous miner 92 is approximately nine to twelve feet in length. The trajectory of the coal coming off the boom 93 allows it to load conventional sleds of eleven to twelve feet in length. With the sled 89 pulled into position behind the continuous miner 92, the miner boom 93 starts to load the fixed length sled 89. As the conventional sled 89 is filled, video cameras (not shown) on the continuous miner 92 enable an operator to actuate the pull-out winch 95 thereby enabling the pull-out rope 96 to pull the loading sled away from the continuous miner 92. As the sled 89 is being loaded, the operator continues pulling the sled forward distributing the load thereon, until the entire length of the sled 89 is loaded. After the coal is loaded on the conventional sled 89, the pull-out rope 96 is actuated by the pull-out winch 95 to pull the sled 89 out of the mine.

Figure 13:
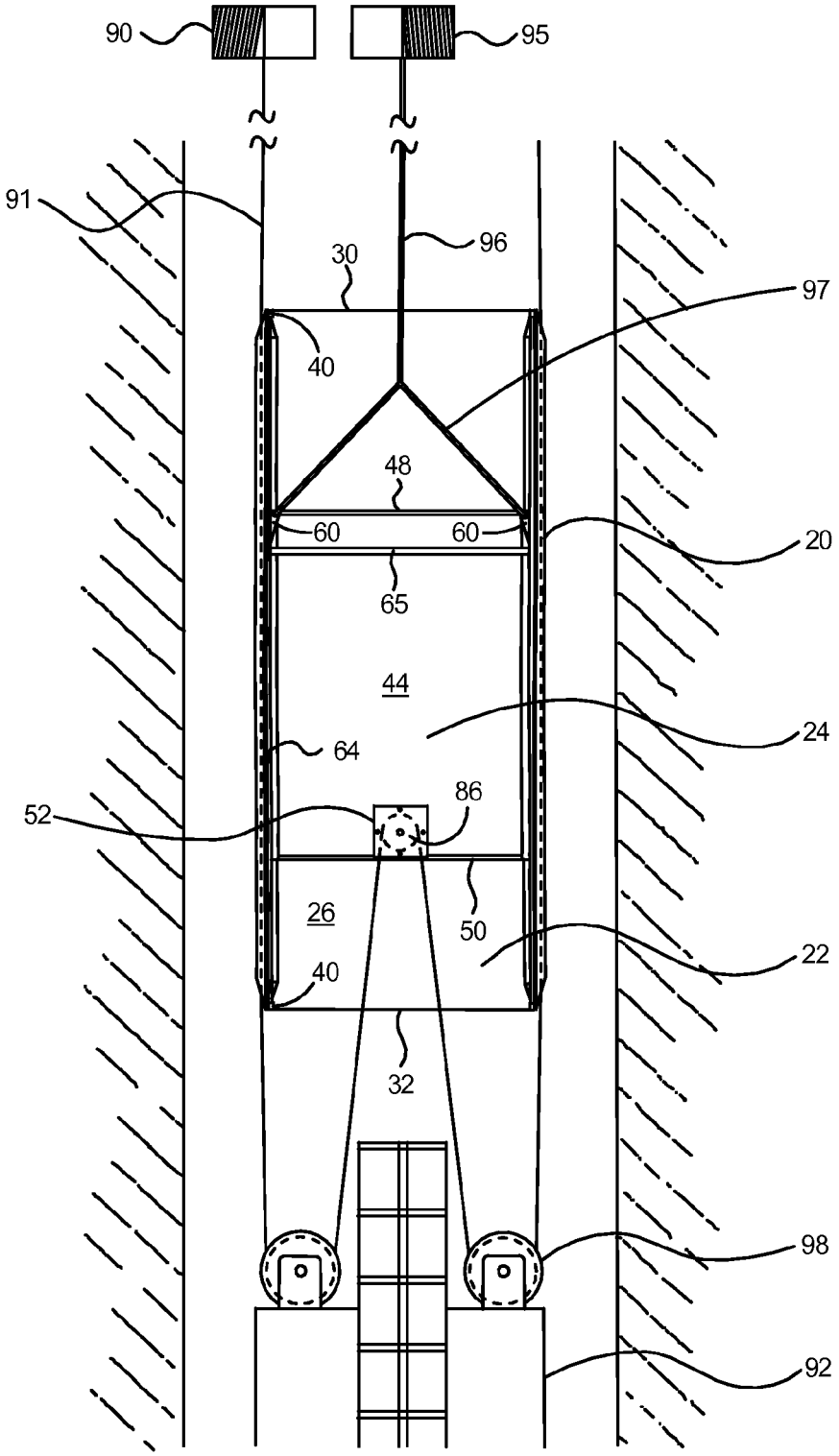
FIG. 13 is an overhead view of a winch-operated mining system utilizing the mining sled of the present invention.

Referring to FIG. 13, there is shown a winch-operated highwall mining system using the mining sled 20 of the present invention. The mining sled with movable bed 20 of the present invention substantially increases production by essentially doubling the tonnage of ore that is carried out of the highwall shaft on each winch cycle. The mining sled with movable bed 20 preferably includes a sled body 22 of eighteen feet length or longer with an inner movable bed 24 within the sled body 22. The movable bed 24 is approximately one-half the length of the sled body 22 and is slideable within the sled body 22.

In the mining sled 20 of the present invention, the pull-in rope 91 and pull-out rope 96 are both attached to the movable bed 24 rather than to a fixed-length sled as in the prior art. A sling 97 connects the pull-out rope 96 to the brackets 60 at the pull-out end 48 of the movable bed 24. In the loading cycle, when the sled 20 is pulled into the mine toward the continuous miner 92, the wire pull-in rope 91 is wound around pulleys 98 on the continuous miner 92 and around the pull-in pulley 86 on the movable bed 24. Actuating the pull-in winch 90 pulls the movable bed 24 to the pull-in end 32 of the sled body 22. The bed stops 40 on the sled body 22 function to keep the movable bed 24 within the sled body 22. After the movable bed 24 is pulled to the pull-in end 32 of the sled body 22, it is in position behind the continuous miner 92 and ready to accept a load. As the movable bed 24 is loaded, the remote operator utilizes the video cameras mounted on the continuous miner 92 to gradually pull the movable bed 24 toward the pull-out end 30 of the sled body 22. After the movable bed 24 is loaded, the operator gradually pulls the movable bed 24 forward until the total mining sled 20 is loaded including the sled base 26 and the bed base 44. Both connections to the winches 90 and 95, including the pull-in rope 91 and pull-out rope 96, are attached to the inner movable and sliding bed 24. The movable bed 24 is held within the sled body 22 by the sleeves 64 extending from the sled sidewalls 28 and by the bed stops 40 at each end 30 and 32 of the sled body 22. As the sling 97 exerts an inward force on the bed sidewalls 46, spreader bar 65 extends between the bed sidewalls 46 thereby strengthening them and keeping them parallel to each other. By substantially doubling the load per winch cycle and eliminating an extra pull-in cycle and pull-out cycle, the mining sled with movable bed 20 of the present invention provides a significant boost in productivity of winch-operated highwall mining systems.

The sled body 22 and movable bed 24 of the mining sled of the present invention are both preferably constructed of metal. Most preferably, the sled body 22 and movable bed 24 are constructed of steel.

Although the description above contains many specific descriptions, materials, and dimensions, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A mining sled comprising:

a sled body including a sled base and sled sidewalls extending from said sled base, said sled sidewalls including an inner surface and an outer surface;

a movable bed slideable within said sled body, said movable bed including a bed base, bed sidewalls, a pull-out end, and a pull-in end;

a bed stop at each end of said sled body;

a pulley secured to said bed base at said pull-in end; and a cable attachment mechanism at said pull-out end of said movable bed.

2. The mining sled of claim 1 including two rub rails extending longitudinally along said outer surface of said sled sidewalls.

3. The mining sled of claim 2 including a rope channel on said outer surface of said sled sidewalls between said rub rails.

4. The mining sled of claim 1 including sloped corners on said movable bed at the juncture of said bed base and said bed sidewalls.

5. The mining sled of claim 1 wherein said pulley includes a pulley support extending from said bed base.

6. The mining sled of claim 5 wherein said pulley support includes a base plate; and a top plate.

7. The mining sled of claim 6 wherein said pulley support includes a plurality of struts extending between said base plate and said top plate.

8. The mining sled of claim 6 including a shaft extending between said base plate and said top plate and said pulley is mounted on said shaft.

9. The mining sled of claim 6 wherein said pulley support includes legs extending from said bed base to said base plate.

10. The mining sled of claim 1 wherein said cable attachment mechanism is a bracket extending from said movable bed.

11. The mining sled of claim 1 wherein said cable attachment mechanism is a bracket extending from each of said bed sidewalls of said movable bed.

12. The mining sled of claim 11 wherein each of said brackets includes an aperture therein.

13. The mining sled of claim 12 including a spreader bar extending between said bed sidewalls, said spreader bar secured to said bed sidewalls substantially near said brackets.

14. The mining sled of claim 12 wherein said brackets include a sling secured thereto, said sling secured through said apertures in said brackets.

15. The mining sled of claim 1 including a bottom surface on said sled body; and a skid plate on said bottom surface of said sled body.

16. The mining sled of claim 1 including a sleeve extending along said inner surface of each of said sled sidewalls.

17. The mining sled of claim 16 wherein said sleeve includes a base and a lip defining a channel therein.

18. The mining sled of claim 1 including a plow edge on said bed base at said pull-out end of said movable bed and a plow edge on said bed base at said pull-in end of said movable bed.

19. The mining sled of claim 1 wherein said sled body and said movable bed are constructed of steel.

* * * * *